US011592782B2

(12) United States Patent
Koga

(10) Patent No.: US 11,592,782 B2
(45) Date of Patent: Feb. 28, 2023

(54) IMAGE FORMING APPARATUS

(71) Applicant: CANON KABUSHIKI KAISHA, Tokyo (JP)

(72) Inventor: Satoshi Koga, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/685,274

(22) Filed: Mar. 2, 2022

(65) Prior Publication Data

US 2022/0291626 A1 Sep. 15, 2022

(30) Foreign Application Priority Data

Mar. 10, 2021 (JP) ..... JP2021-038668

(51) Int. Cl.
*G03G 21/18* (2006.01)
*G03G 15/01* (2006.01)

(52) U.S. Cl.
CPC ..... *G03G 21/185* (2013.01); *G03G 15/0142* (2013.01); *G03G 15/0147* (2013.01); *G03G 15/0194* (2013.01); *G03G 21/186* (2013.01); *G03G 2221/1861* (2013.01); *G03G 2221/1869* (2013.01)

(58) Field of Classification Search
CPC ..... G03G 15/0142; G03G 15/0147; G03G 15/0194; G03G 21/185; G03G 21/186; G03G 2221/1861; G03G 2221/1869
See application file for complete search history.

(56) References Cited

U.S. PATENT DOCUMENTS

| | | | | |
|---|---|---|---|---|
| 7,756,441 B2 * | 7/2010 | Kanno | ..... | G03G 21/1842 399/114 |
| 2006/0045566 A1 * | 3/2006 | Kanno | ..... | G03G 21/1825 399/111 |
| 2022/0075312 A1 * | 3/2022 | Ozaki | ..... | G03G 21/186 |

FOREIGN PATENT DOCUMENTS

| | | | |
|---|---|---|---|
| JP | H11249528 | A | 9/1999 |
| JP | 2005049525 | A | 2/2005 |
| JP | 2007058058 | A | 3/2007 |
| JP | 2007213024 | A | 8/2007 |
| JP | 2017156435 | A | 9/2017 |

* cited by examiner

*Primary Examiner* — Joseph S Wong
(74) *Attorney, Agent, or Firm* — Canon U.S.A. Inc. I.P. Division

(57) ABSTRACT

An image forming apparatus includes a cartridge and a main body into which the cartridge is removably installed. The cartridge includes a first unit and a second unit that is movably connected to the first unit. The main body includes a rotating member, a supporting member disposed at a position away from the rotating member, and a swingable member that is pivotally movable about the supporting member and configured to be moved by the rotating member. The swingable member is movable between a first position at which the swingable member is in contact with the second unit and a second position at which the swingable member is retracted from the first position. Installation and removal of the cartridge into and from the main body is enabled in a state where the swingable member is at the first position and is supported by the rotating member.

13 Claims, 10 Drawing Sheets

IMAGE FORMING APPARATUS

BACKGROUND OF THE DISCLOSURE

Field of the Disclosure

The present disclosure relates to an image forming apparatus employing an electrophotographic process, such as a printer, a copier, or a facsimile.

Description of the Related Art

Image forming apparatuses employing the electrophotographic process are often configured such that processing devices for image forming are packed in a cartridge and the cartridge can be installed into or removed from a main body of the apparatus.

A cartridge of a known image forming apparatus is configured such that the main body of the apparatus moves a portion of the cartridge. Japanese Patent Laid-Open No. 2007-213024 discloses an image forming apparatus in which the main body includes a separation member for causing the cartridge to operate so as to separate a developing roller from a photosensitive drum. Japanese Patent Laid-Open No. 2007-58058 discloses an image forming apparatus in which the main body includes a cam for separating the developing roller from the photosensitive drum.

In the case in which the main body of the image forming apparatus includes a rotating member that moves a portion of the cartridge, the cartridge may exert a force on the rotating member of the main body and may cause the rotating member to rotate when the cartridge is installed into or removed from the main body.

SUMMARY OF THE DISCLOSURE

Accordingly, embodiments of the present disclosure provide an image forming apparatus that can reduce the likelihood of the cartridge exerting a force on the rotating member of the main body and causing the rotating member to rotate when the cartridge is installed into or removed from the main body.

According to an aspect of the present disclosure, an image forming apparatus includes a cartridge including a first unit and a second unit that is movably connected to the first unit and also includes a main body into which the cartridge is removably installed. The main body includes a rotating member rotatable about a rotation axis, a supporting member disposed at a position away from the rotating member, and a swingable member that is pivotally movable about the supporting member and is configured to be moved by the rotating member. The swingable member includes (i) a first contact surface configured to come into contact with the rotating member, (ii) a second contact surface configured to come into contact with the second unit and (iii) a supported portion supported by the supporting member. The swingable member is movable between a first position at which the swingable member is in contact with the second unit and a second position at which the swingable member is retracted from the first position. Installation and removal of the cartridge into and from the main body is enabled in a state where the swingable member is at the first position and is supported by the rotating member.

Further features of the present disclosure will become apparent from the following description of exemplary embodiments with reference to the attached drawings.

DESCRIPTION OF THE EMBODIMENTS

Embodiments of the disclosure will be described in detail with reference to the drawings. Functions, materials, shapes, arrangements, or the like, of elements described in the following embodiments are not intended to specifically limit the scope of the present disclosure unless expressly stated otherwise.

In the embodiments described below, the "up-down direction" is defined as the gravity direction (the vertical direction) unless expressly stated otherwise. Note that the gravity direction is to be defined when an apparatus or a component to which the present disclosure is applied is positioned in normal operation conditions. When the image forming apparatus forms an image on a recording medium normally, the image forming apparatus is positioned in the normal operation conditions.

First Embodiment

Structure of Image Forming Apparatus

Figure 1:
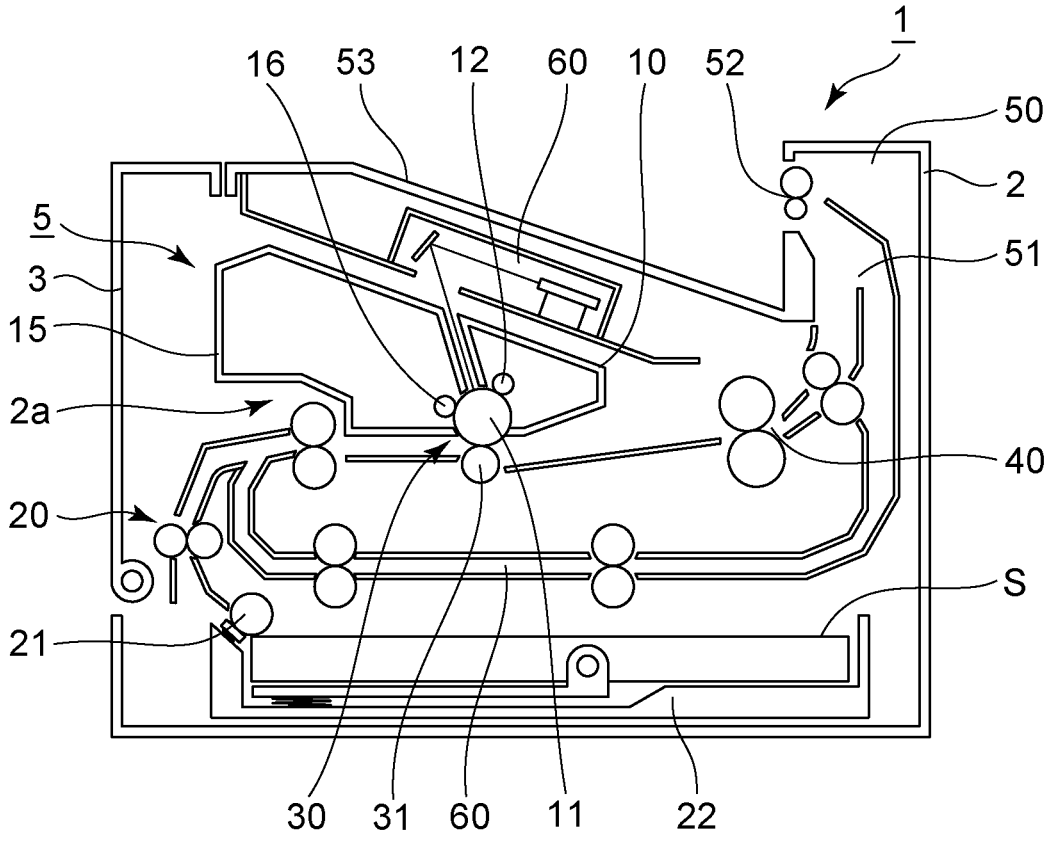
FIG. 1 is a cross-sectional view schematically illustrating a structure of the image forming apparatus.

A structure of an image forming apparatus 1 will be described with reference to FIG. 1. FIG. 1 is a cross-sectional view schematically illustrating the structure of the image forming apparatus 1. Examples of the image forming apparatus include an electrophotographic copying machine, an electrophotographic printer (LED printer, laser beam printer, etc.), a facsimile, and a word processor.

As illustrated in FIG. 1, the image forming apparatus 1 includes a processing cartridge (a cartridge or a replaceable unit) 5 and a main body 2 into which the processing cartridge 5 is removably installed.

The main body 2 includes a stacking tray (sheet feeding cassette) 22 in which sheets (recording media) S are stacked, a sheet conveyance unit 20, a transfer roller 31, a fixing unit 40, a sheet discharge unit 50, and a scanner 60 that serves as an exposure device. The main body 2 also include a cover (openable/closable member) 3 that covers an installation opening through which the processing cartridge 5 is removably installed. When the cover 3 is open, the installation opening is exposed.

The processing cartridge 5 includes a drum unit (first unit) 10 and a developing unit (second unit) 15 that is movably connected to the drum unit 10.

The drum unit 10 includes a photosensitive drum 11 that serves as an image carrying member for carrying an electrostatic latent image and also includes a charging roller (charging member) 12 that charges the photosensitive drum 11 with electricity. The developing unit 15 includes a developing roller 16 that serves as a developer carrying member for developing the electrostatic latent image. The developing roller 16 carries a developer (toner). In the present embodiment, the drum unit 10 and the developing unit 15 are connected to each other and thereby integrally form the processing cartridge 5. In this state, the processing cartridge 5 is removably installed into the main body 2.

Next, image forming operation of the image forming apparatus 1 will be described.

The surface of the photosensitive drum 11, which is rotated by a drive source (not illustrated), is charged uniformly with electricity to a predetermined potential by the charging roller 12. The charged surface of the photosensitive drum 11 is exposed by the scanner 60 according to image information, thereby forming an electrostatic latent image on the surface of the photosensitive drum 11. The developing roller 16 supplies toner to the electrostatic latent image formed on the surface of the photosensitive drum 11. As a result, the electrostatic latent image is visualized as a toner image.

While the toner image is being formed, a feed roller 21 starts to rotate to pick up and convey a topmost sheet (recording medium) S stacked in the sheet feeding cassette 22. The sheet S is conveyed to a transfer portion 30, which is formed of the photosensitive drum 11 and the transfer roller 31, in synchronization with the toner image being formed on the photosensitive drum 11.

While the sheet S is passing through the transfer portion 30, the toner image is transferred onto the sheet S as an unfixed image due to a transfer bias being applied to the transfer roller 31. The sheet S on which the toner image is transferred is subsequently conveyed to the fixing unit 40.

When the sheet S passes the fixing unit 40, the fixing unit 40 heats and presses the sheet S and thereby fixes the unfixed image onto the surface of the sheet S. The sheet S on which the toner image is fixed is subsequently conveyed into a discharge path 51.

When an image is to be formed only on one side of the sheet S, the sheet S is discharged by a discharge roller pair 52 from the discharge path 51 to a discharge tray 53, and the sheet S is stacked thereon. When images are to be formed on both sides of the sheet S, the sheet S reaches the discharge roller pair 52, and the discharge roller pair 52 subsequently starts to rotate reversely. The sheet S is conveyed into a reconvey path 60 and further to the transfer portion 30 again with the sheet S being flipped over. Subsequently, as is the case for forming an image on one side of the sheet S, an image is formed and fixed on the back side of the sheet S. Finally, the sheet S is stacked on the discharge tray 53.

Structure of Processing Cartridge

The processing cartridge 5 according to the present embodiment will be described with reference to FIGS. 2, 3, and 4.

Figure 2A:
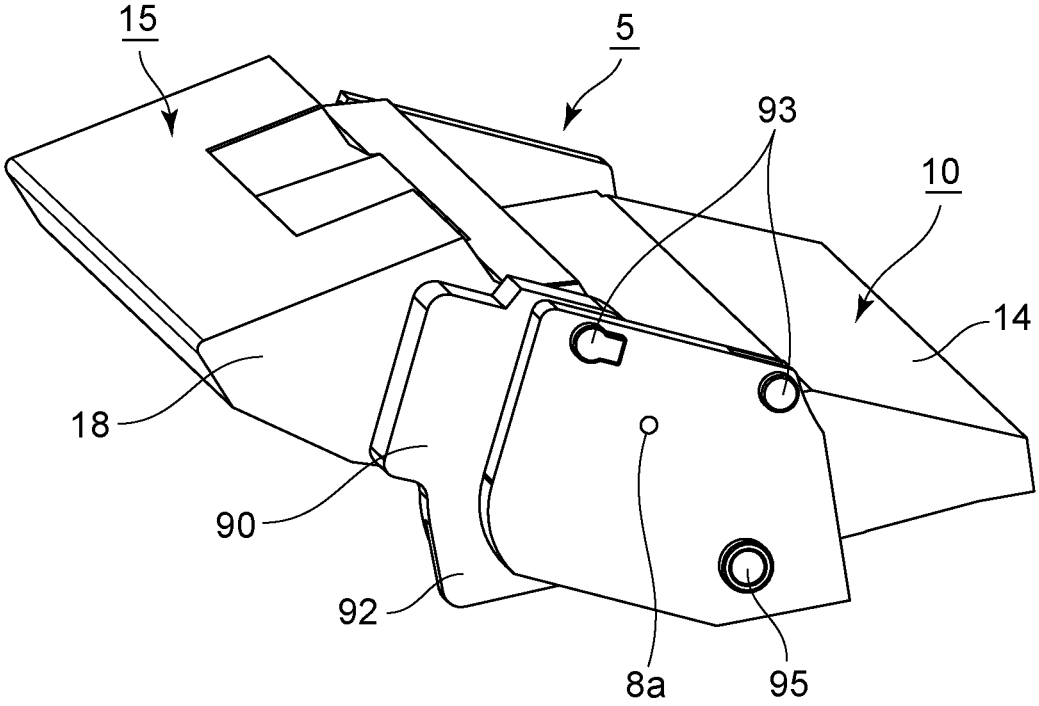
FIGS. 2A and 2B are perspective views illustrating the exterior of a processing cartridge.
Figure 2B:
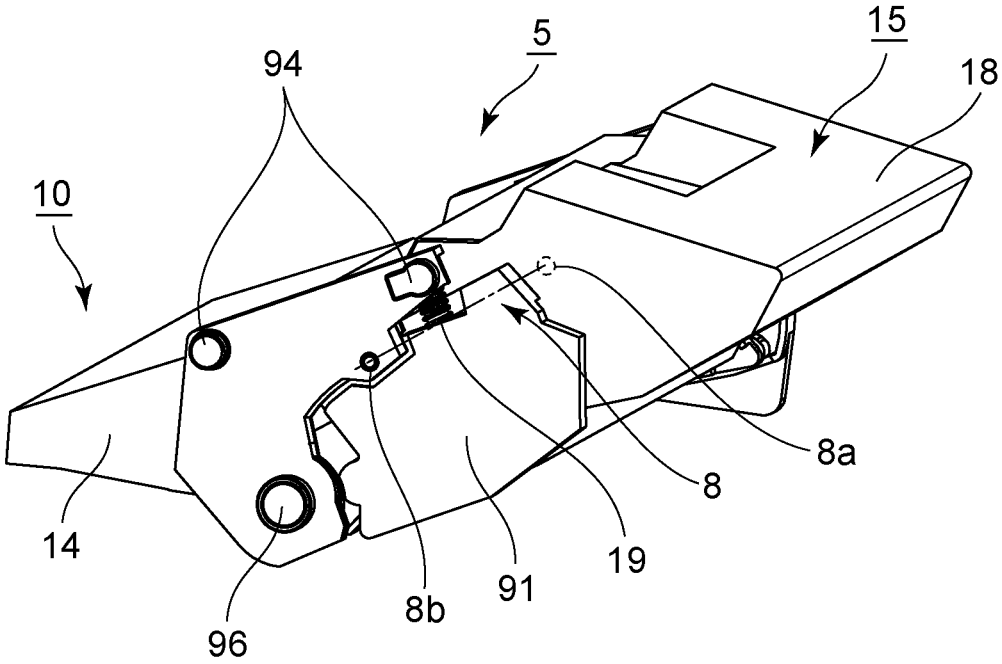

FIGS. 2A and 2B are perspective views illustrating the exterior of the processing cartridge 5. FIG. 2A is a perspective view when a side of the processing cartridge 5 is viewed. FIG. 2B is a perspective view when a different side of the processing cartridge 5 is viewed.

Figure 3:
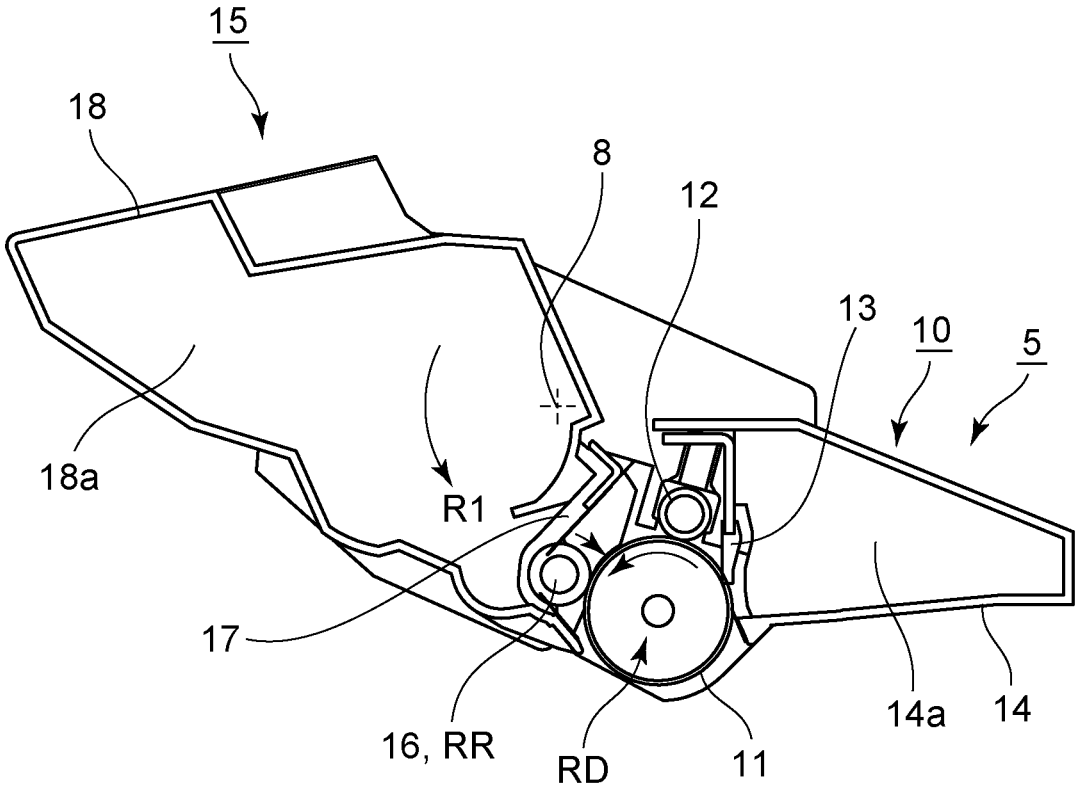
FIG. 3 is a cross-sectional view illustrating the processing cartridge when a developing roller is in contact with a photosensitive drum.

FIG. 3 is a cross-sectional view illustrating the processing cartridge 5 when the developing roller 16 is in contact with the photosensitive drum 11. FIG. 4 is a cross-sectional view illustrating the processing cartridge 5 when the developing roller 16 is away from the photosensitive drum 11. FIGS. 3 and 4 are sections cut in a direction perpendicular to a rotation axis RD of the photosensitive drum 11.

In the present embodiment, as illustrated in FIGS. 2A and 2B, the developing unit 15 and the drum unit 10 are joined to each other at a fulcrum 8*a* and a fulcrum 8*b*. The developing unit 15 is joined to the drum unit 10 so as to be able to rotate about a straight line (i.e., unit-rotation center, or unit-rotation axis) 8 between the fulcrum 8*a* and the fulcrum 8*b*.

As illustrated in FIG. 3, the photosensitive drum 11 rotates about the rotation axis RD in the arrow direction (counterclockwise in the figure). The charging roller 12 is in contact with the photosensitive drum 11 and rotates so as to follow the rotation of the photosensitive drum 11. The drum unit 10 has a cleaning blade 13 serving as a cleaning member. The cleaning blade 13 has an end portion made of an elastic member, such as rubber, and the end portion is disposed so as to be in contact with the photosensitive drum 11. The cleaning blade 13 removes residual toner remaining on the photosensitive drum 11. The toner collected by the cleaning blade 13 is stored in a collected toner container 14*a* disposed at a drum frame 14 for the drum unit 10.

As illustrated in FIG. 3, the developing roller 16 rotates about a rotation axis RR in the arrow direction (clockwise in the figure). The developing unit 15 has a developing blade 17 that serves as a control member that controls the thickness of the toner carried on the developing roller 16. The developing unit 15 has a developer container 18 as part of a development frame member. The developer container 18 has a toner chamber 18*a* for toner storage. The developing roller 16 is disposed so as to partially face the toner chamber 18*a* and partially face the outside of the developer container 18. The toner stored in the toner chamber 18*a* is supplied to, and subsequently carried on, the developing roller 16. The developing unit 15 may have a conveying member in the toner chamber 18*a*. The conveying member conveys toner toward the developing roller 16.

The developing blade 17 is disposed such that the end portion of the developing blade 17 is in contact with the developing roller 16. The developing blade 17 serves to control the thickness of the toner so as to obtain a thin layer on the circumferential surface of the developing roller 16.

The developing unit 15 is movable between a development position (see FIG. 3) at which the developing unit 15 develops an electrostatic latent image and a retracted position (see FIG. 4) at which the developing unit 15 is retracted from the development position. In the present embodiment, the developing unit 15 is movable between a contact position at which the developing roller 16 is in contact with the photosensitive drum 11 and a separated position at which the developing roller 16 is away from the photosensitive drum 11. More specifically, the developing unit 15 rotates (pivotally moves) about the unit-rotation axis 8 and thereby moves between the contact position and the separated position.

The processing cartridge 5 has a pressurizing spring (elastic member, urging member) 19 that urges the developing unit 15 toward the drum unit 10. The developing unit 15 is urged by the pressurizing spring 19 in a direction of the developing roller 16 coming closer to the photosensitive drum 11. The urging force of the pressurizing spring 19 causes a moment to act on the developing unit 15 about the unit-rotation axis 8 in the direction R1 in FIG. 3. The developing roller 16 is thereby pressed against the photosensitive drum 11 at a predetermined pressure. Here, this position of the developing unit 15 relative to the drum unit 10 is the contact position of the developing unit 15.

When the developing unit 15 is at the contact position, the electrostatic latent image formed on the photosensitive drum 11 is developed by the toner carried on the developing roller 16. In other words, in the present embodiment, the contact position is the development position.

As illustrated in FIGS. 2A and 2B, the developing unit 15 has a bearing member 90 and a bearing member 91 as parts of the development frame member. The bearing member 90 and the bearing member 91 are positioned at respective end portions of the developing roller 16 in the axial direction thereof (in the direction of the rotation axis RR). The bearing member 90 has a projection 92. The projection 92 receives a force from a separation mechanism 100 disposed in the main body 2, which will be described later.

Figure 4:
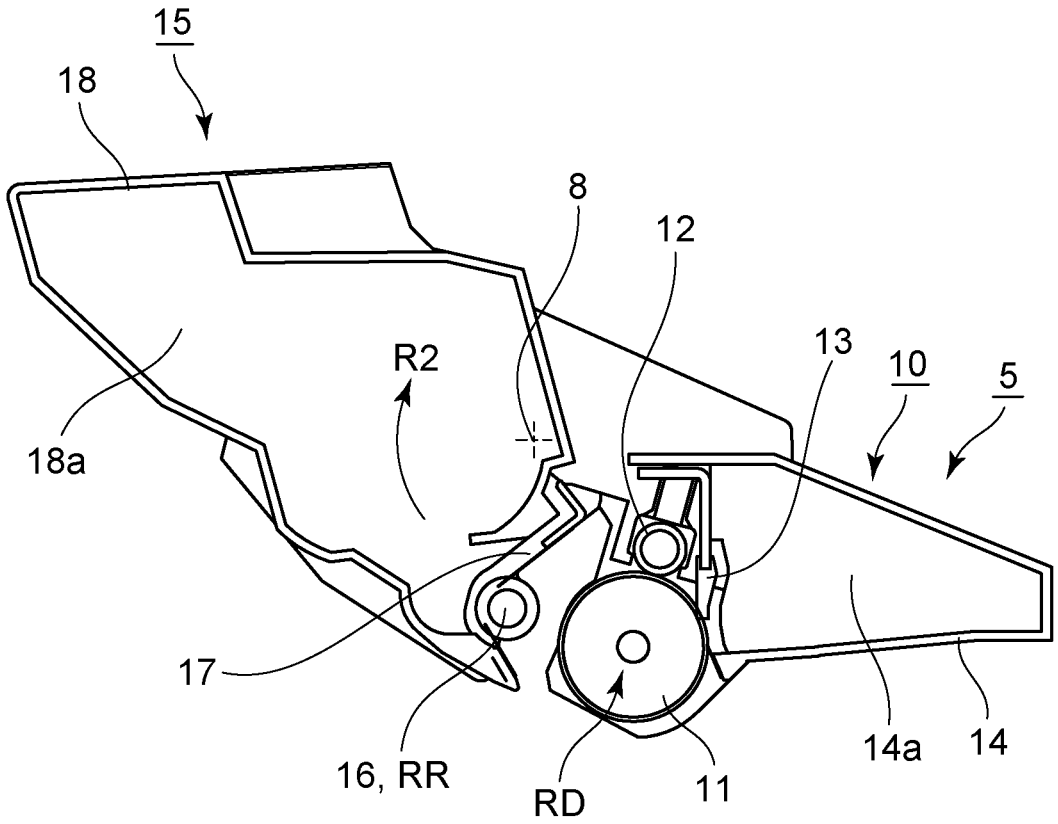
FIG. 4 is a cross-sectional view illustrating the processing cartridge when the developing roller is away from the photosensitive drum.

As illustrated in FIG. 4, the developing unit 15 rotates in the direction R2 about the unit-rotation axis 8 due to the projection 92 receiving a force from the separation mechanism 100. As a result, the developing unit 15 is retracted from the development position, thereby separating the developing roller 16 from the photosensitive drum 11. Here, the position of the developing unit 15 relative to the drum unit 10 is the separated position of the developing unit 15.

In other words, in the present embodiment, the retracted position is the separated position. The distance between the developing roller 16 and the photosensitive drum 11 when the developing roller 16 is at the retracted position is greater than the distance between the developing roller 16 and the photosensitive drum 11 when the developing roller 16 is at the development position.

Installation and Removal of Processing Cartridge

Figure 5:
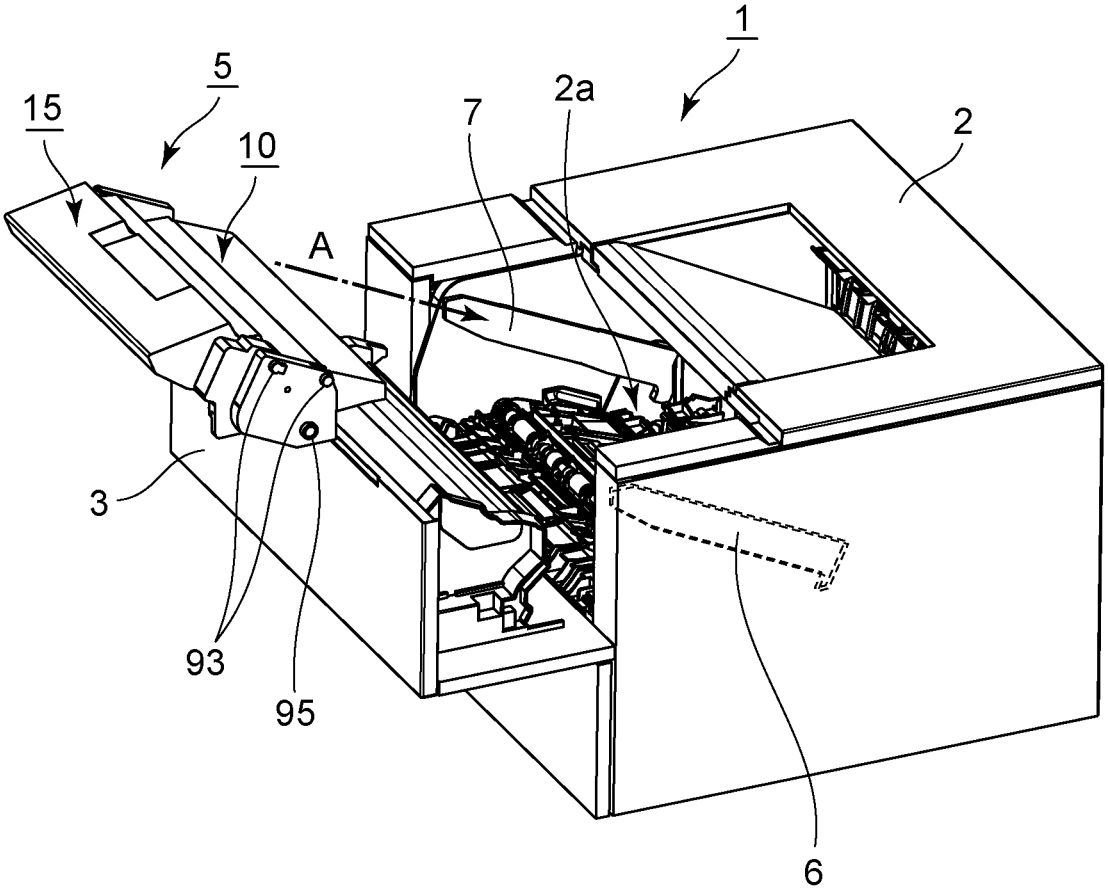
FIG. 5 is a perspective view illustrating the exterior of the image forming apparatus.

Installation and removal of the processing cartridge 5 into and from the main body 2 will be described with reference to FIGS. 2A, 2B, and 5. FIG. 5 is a perspective view illustrating the exterior of the image forming apparatus 1.

As illustrated in FIG. 5, an installation portion 2*a* for receiving the processing cartridge 5 is formed in the main body 2. FIG. 5 is a perspective view illustrating the exterior of the image forming apparatus 1 when the cover 3 is open. The cover 3 is pivotally disposed at the main body 2.

The main body 2 has a guiding portion 6 and a guiding portion 7 that are formed so as to guide the processing cartridge 5 toward the installation portion 2*a*.

On the other hand, as illustrated in FIGS. 2A and 2B, the processing cartridge 5 has upper bosses 93, upper bosses 94, a lower boss 95, and a lower boss 96, which serve as guided portions (protrusions). In the present embodiment, the drum frame 14 of the drum unit 10 has the upper bosses 93, the upper bosses 94, the lower boss 95, and the lower boss 96.

The processing cartridge 5 is inserted into the image forming apparatus 1 in the direction A in FIG. 5 in the state in which the guiding portion 6 are interposed between the upper bosses 93 and the lower boss 95 and the guiding portion 7 are interposed between the upper bosses 94 and the lower boss 96. The processing cartridge 5 is installed into and removed from the main body 2 in a direction intersecting (or orthogonally intersecting) the rotation axis RD of the photosensitive drum 11.

Image forming operation is performed with the processing cartridge 5 being installed at the installation portion 2*a*.

Image forming is enabled after the processing cartridge 5 is installed at the installation portion 2*a* and the cover 3 is closed. When the processing cartridge 5 is installed at the installation portion 2*a*, the lower boss 95 and the lower boss 96 are positioned appropriately with respect to the main body 2, and the drum unit 10 is thereby positioned appropriately with respect to the main body 2. The lower boss 95 and the lower boss 96 serve as portions for positioning the processing cartridge 5 with respect to the main body 2. In this state, the separation mechanism 100 (which will be described later) can move the developing unit 15 relative to the drum unit 10 between the contact position and the separated position.

When the processing cartridge 5 is removed from the main body 2, the above installation procedure is reversed.

Separation Mechanism

Next, the separation mechanism 100 disposed in the main body 2 will be described with reference to FIGS. 6, 7, and 8.

Figure 6:
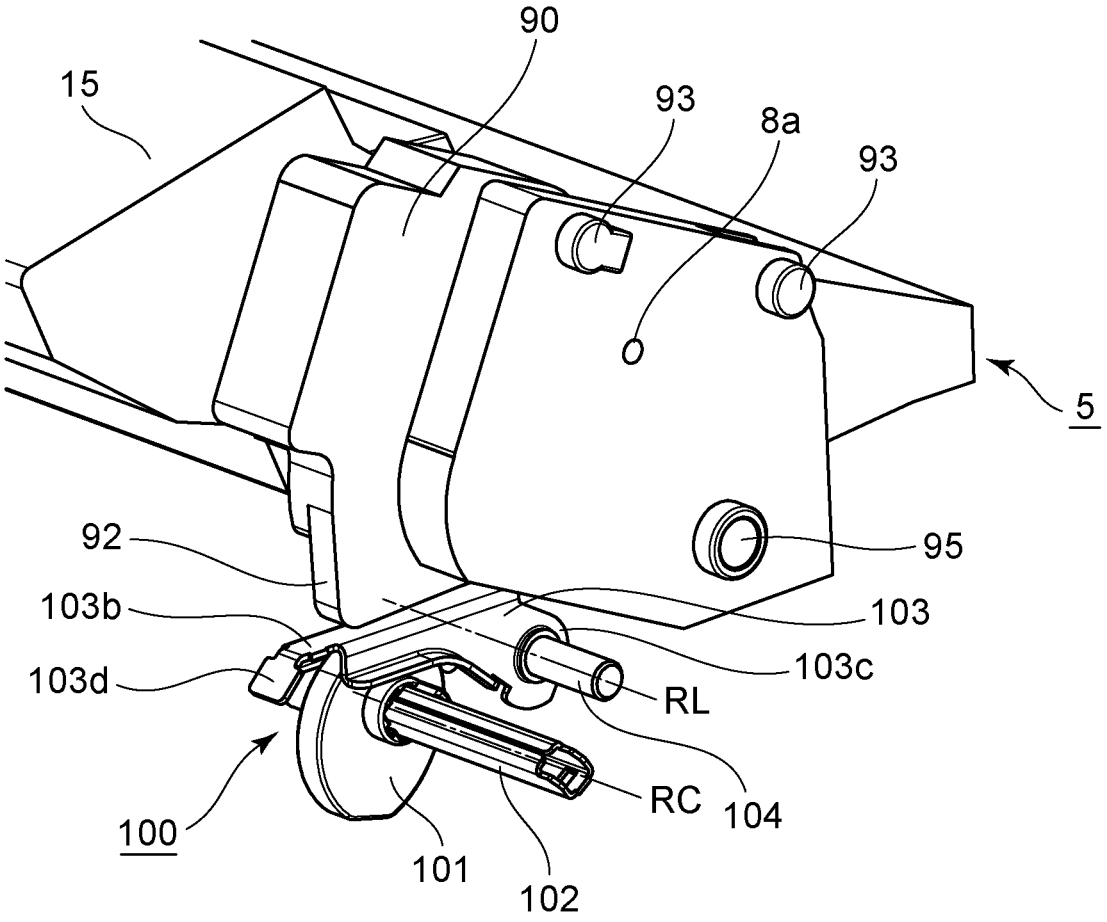
FIG. 6 is a perspective view illustrating a relationship between the processing cartridge and a separation mechanism.

FIG. 6 is a perspective view illustrating a relationship between the processing cartridge 5 and the separation mechanism 100. FIG. 7 is a view for explaining a connection of a control unit 2*b*, a drive source 2*c*, and the separation mechanism 100 in the main body 2.

Figure 8A:
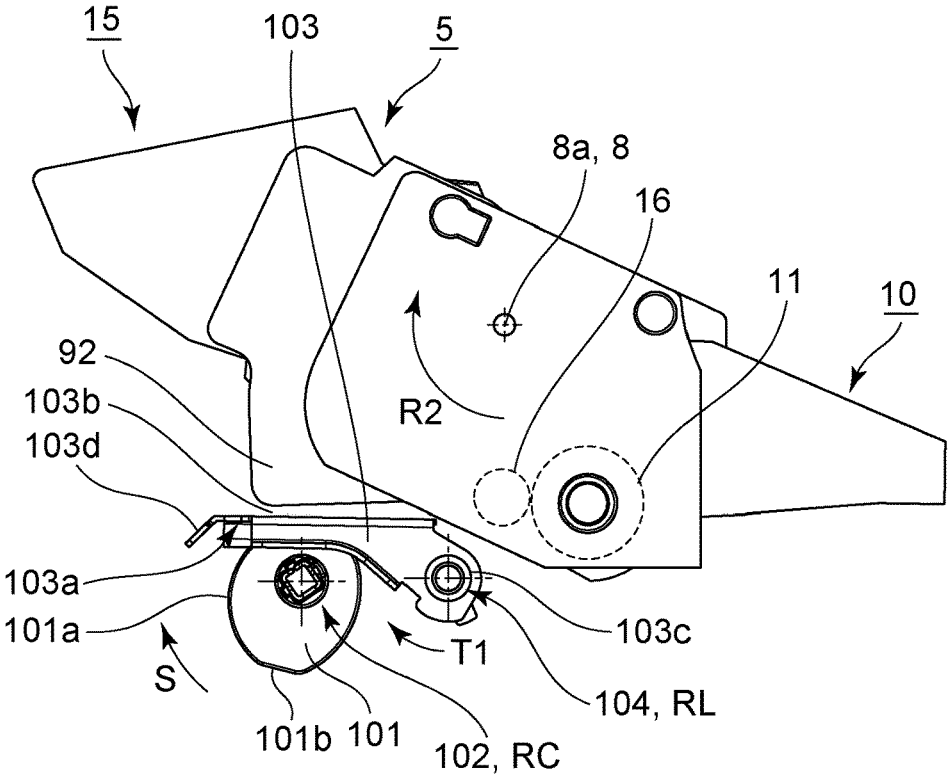
FIGS. 8A and 8B are views for explaining operation of the separation mechanism in a first embodiment.
Figure 8B:
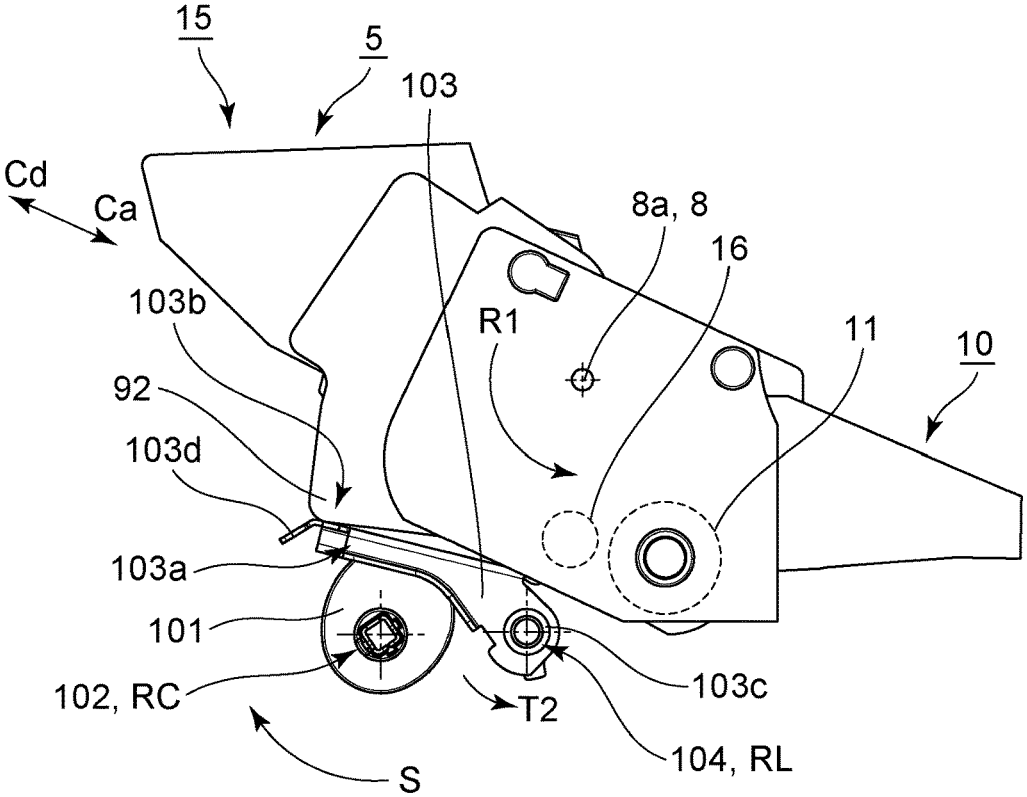

FIGS. 8A and 8B are views for explaining operation of the separation mechanism 100. FIG. 8A is a side view illustrating a relationship between the processing cartridge 5 and the separation mechanism 100 when the developing unit 15 is at the contact position. FIG. 8B is a side view illustrating a relationship between the processing cartridge 5 and the separation mechanism 100 when the developing unit 15 is at the separated position.

The main body 2 has the separation mechanism 100. The separation mechanism 100 is disposed at a position between both ends of the processing cartridge 5 in the longitudinal direction thereof (which is the same direction of the rotation axis RR of the developing roller 16 or of the rotation axis RD of the photosensitive drum 11). The separation mechanism 100 is disposed under the developing unit 15.

The separation mechanism 100 includes a rotating cam (rotating member) 101, a shaft (supporting member) 104, and a lever member (swingable member) 103. The rotating cam 101 is rotatable about a rotation axis RC. The shaft 104 is disposed at a position away from the rotating cam 101. The lever member 103 is swingable (pivotally movable) about the shaft 104. The rotating cam 101 causes the lever member 103 to move.

Since the separation mechanism 100 is disposed at a position between both ends of the processing cartridge 5 in the longitudinal direction thereof, the developing unit 15 can be switched between the contact position and the separated position without increasing the width of the main body 2.

Figure 7:
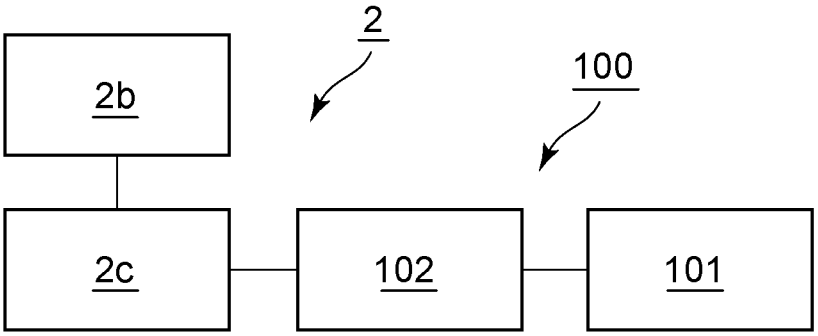
FIG. 7 is a view for explaining a connection of a control unit, a drive source, and the separation mechanism.

As illustrated in FIG. 7, the main body 2 includes a motor 2*c* and the control unit 2*b*. The motor 2*c* serves as a drive source for driving the rotating cam 101, and the control unit 2*b* controls the motor 2*c*. The control unit 2*b* controls the motor 2*c* in such a manner that the developing unit 15 moves between the separated position and the contact position at a predetermined timing.

The rotating cam 101 is rotatably supported by the main body 2 with a cam driving shaft 102 interposed therebetween.

The motor 2*c* is connected to the cam driving shaft 102. The motor 2*c* rotates the cam driving shaft 102 and thereby rotates the rotating cam 101. In the present embodiment, the rotating cam 101 is made of a resin, and the cam driving shaft 102 is formed by folding a metallic plate.

The lever member 103 has a first contact surface 103*a*, a second contact surface 103*b*, and a supported portion 103*c* (see FIGS. 8A and 8B). The first contact surface 103*a* is configured to come into contact with the rotating cam 101, and the second contact surface 103*b* is configured to come into contact with the projection 92 of the developing unit 15. The supported portion 103*c* is supported by the shaft 104. The first contact surface 103*a* opposes the rotating cam 101, and the second contact surface 103*b* opposes the projection 92 of the developing unit 15. The first contact surface 103*a* is positioned at the back side of the second contact surface 103*b*. In the direction of the rotation axis RC of the rotating cam 101 (in a direction parallel to a rotation axis RL of the lever member 103), the first contact surface 103*a* and the second contact surface 103*b* are positioned so as to overlap each other at least partially. With respect to the direction of the rotation axis RC of the rotating cam 101, a position of the first contact surface 103*a* and a position of the second contact surface 103*b* overlap each other at least partially. In other words, as viewed in a direction orthogonal to the rotation axis RC of the rotating cam 101, the first contact surface 103*a* and the second contact surface 103*b* overlaps each other.

The supported portion 103*c* engages the shaft 104, and the shaft 104 of the main body 2 thereby pivotally supports the lever member 103. In the present embodiment, the supported portion 103*c* is shaped as a hole into which the shaft 104 is inserted.

The lever member 103 functions as a cover member to cover the rotating cam 101. When the processing cartridge 5 is installed into or removed from the main body 2, the developing unit 15 of the processing cartridge 5 comes into contact with the lever member 103. Accordingly, the lever member 103 prevents the developing unit 15 from coming into direct contact with the rotating cam 101.

The lever member 103 may be made of a metal or a resin or both. In the case of the lever member 103 containing a metallic material, at least one of the first contact surface 103*a* and the second contact surface 103*b* may be made of the metallic material. In the present embodiment, the lever member 103 is formed by folding a metallic plate. In the case of the lever member 103 containing the metallic material, the metallic material can reduce wear of the lever member 103.

The shaft 104 is disposed at a position different from the cam driving shaft 102 in the insertion direction of the processing cartridge 5. The lever member 103 is disposed above the rotating cam 101 and is brought into contact with a cam surface 101*a* of the rotating cam 101 by its own weight. Rotation of the rotating cam 101 pivotally moves the lever member 103 about a lever axis (rotation axis, pivotal movement axis) RL.

Operation of the separation mechanism 100 will be described with reference to FIGS. 8A and 8B.

The lever member 103 is movable between a first position at which the lever member 103 is in contact with the developing unit 15 and a second position at which the lever member 103 is retracted from the first position. In the present embodiment, the rotating cam 101 presses the lever member 103 and thereby moves the lever member 103 from the second position to the first position. In other words, the rotating cam 101 is configured to move the lever member 103 from the second position to the first position. On the other hand, when the lever member 103 moves from the first position to the second position, the lever member 103 moves by its own weight with the rotating cam 101 supporting the lever member 103 so as to follow the rotation of the rotating cam 101.

As illustrated in FIG. 8A, when the lever member 103 is at the second position, the lever member 103 is away from the projection 92 of the developing unit 15, and the developing unit 15 is at the contact position. In the present embodiment, when the lever member 103 is at the second position, the lever member 103 is supported by the rotating cam 101. Note that the lever member 103 may be supported by a member other than the rotating cam 101 when the lever member 103 is at the second position. In this case, a gap is formed between the rotating cam 101 and the lever member 103.

The motor 2*c* drives the cam driving shaft 102 and thereby rotates the rotating cam 101 in direction S. When the rotating cam 101 rotates while the lever member 103 is at the second position and the developing unit 15 is at the contact position, the lever member 103 pivotally moves in direction T1 while the cam surface 101*a* slides on the first contact surface 103*a* of the lever member 103. As a result, the second contact surface 103*b* of the lever member 103 moves closer to the projection 92 of the developing unit 15.

The rotating cam 101 rotates further, and the second contact surface 103*b* of the lever member 103 is thereby brought into contact with the projection 92 of the developing unit 15, and the second contact surface 103*b* presses the developing unit 15 against the urging force of the pressurizing spring 19. Since the drum unit 10 of the processing cartridge 5 is fixedly positioned relative to the main body 2, the developing unit 15 rotates relative to the drum unit 10 about the unit-rotation axis 8 in the direction R2. When the rotating cam 101 rotates 180 degrees from the state in which the lever member 103 is at the second position, the lever member 103 comes to the first position.

As illustrated in FIG. 8B, when the lever member 103 is at the first position, the lever member 103 is in contact with the projection 92 of the developing unit 15, and the developing unit 15 is at the separated position. In the present embodiment, when the lever member 103 is at the first position, the lever member 103 is supported on the rotating cam 101. In this state, the lever member 103 is nipped between the rotating cam 101 and the projection 92 of the developing unit 15.

The processing cartridge 5 can be installed into or removed from the main body 2 in the state in which the lever member 103 is supported on the rotating cam 101 at the first position. The processing cartridge 5 is installed into or removed from the main body 2 in a direction intersecting (or orthogonally intersecting) the rotation axis RC of the rotating cam 101. The processing cartridge 5 is installed into the main body 2 in the installing direction (mounting direction) Ca and is removed from the main body 2 in the removing direction (detaching direction) Cd.

The lever member 103 extends downstream from the supported portion 103*c* in the removing direction Cd of the processing cartridge 5. The rotation axis RC of the rotating cam 101 is positioned downstream from the shaft 104 in the removing direction Cd.

The lever member 103 has a first end portion and a second end portion in the removing direction Cd. The supported portion 103*c* is formed at the first end portion, and the second end portion is positioned oppositely to the first end portion. An inclined surface 103*d* is formed at the second end portion of the lever member 103. The inclined surface 103*d* extends in a direction away from the processing cartridge 5. The inclined surface 103*d* can guide the projection 92 of the developing unit 15 smoothly to the second contact surface 103*b* when the processing cartridge 5 is installed into the main body 2.

When the rotating cam 101 rotates while the lever member 103 is at the first position and the developing unit 15 is at the separated position, the lever member 103 pivotally moves in direction T2 by its own weight while the cam surface 101*a* slides on the first contact surface 103*a* of the lever member 103.

Since the drum unit 10 of the processing cartridge 5 is fixedly positioned relative to the main body 2, the developing unit 15 rotates relative to the drum unit 10 about the unit-rotation axis 8 in direction R1. The rotating cam 101 rotates further, and the developing unit 15 of the processing cartridge 5 reaches the contact position. The second contact surface 103*b* of the lever member 103 is subsequently detached from the projection 92 of the developing unit 15.

When the rotating cam 101 rotates 180 degrees from the position at which the rotating cam 101 supports the lever member 103 at the first position (see FIG. 8B), the rotating cam 101 returns to the position illustrated in FIG. 8A. Now, the lever member 103 is at the second position, the developing unit 15 is at the contact position.

The image forming apparatus 1 is configured such that the developing unit 15 can move repeatedly between the contact position and the separated position using the rotating cam 101 and the lever member 103. The control unit 2*b*, which is disposed in the main body 2, controls the rotation of the rotating cam 101 and thereby enables the developing unit 15 to switch between the contact position and the separated position at a predetermined timing. In the process of image forming on a sheet S, the developing unit 15 is at the contact position when an image is formed, whereas the developing unit 15 is at the separated position when an image is not formed. This reduces deterioration of the photosensitive drum 11, the developing roller 16, and toner, and also suppresses unnecessary toner consumption when the image is not formed.

If the rotating cam 101 came into direct contact with the developing unit 15 of the processing cartridge 5, the developing unit 15 would rub the rotating cam 101 and cause the rotating cam 101 to rotate at installation or removal of the processing cartridge 5. As a result, an unexpected load may be applied to the mechanism (for example, the motor 2*c* and gears between the motor 2*c* and the cam driving shaft 102) for driving the rotating cam 101.

On the other hand, in the case of the rotating cam 101 being covered by the lever member 103 that is supported by the shaft 104, the rotating cam 101 is prevented from rotating at installation or removal of the processing cartridge 5. This reduces the likelihood of an unexpected load being applied to the mechanism for driving the rotating cam 101. In addition, this can prevent the rotating cam 101 from being rotated by an external force when the processing cartridge 5 is removed. Moreover, this can prevent the rotating cam 101 from being worn.

Details of Separation Mechanism

Figure 9:
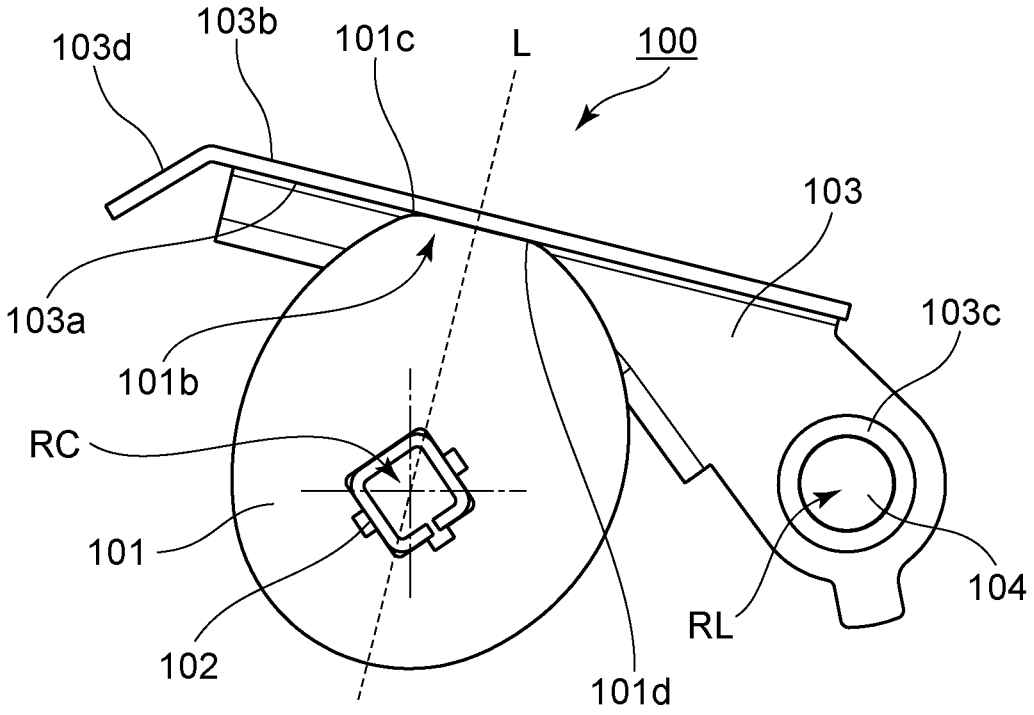
FIG. 9 is a detailed view illustrating the separation mechanism according to the first embodiment.

The separation mechanism 100 will be described in detail with reference to FIG. 9. FIG. 9 is a detailed view of the separation mechanism 100. FIG. 9 illustrates a section of the separation mechanism 100 when the lever member 103 is at the first position.

The rotating cam 101 has an abutment portion 101*b* that comes into contact with the first contact surface 103*a* to hold the lever member 103 at the first position. The abutment portion 101*b* is part of the cam surface of the rotating cam 101.

In the present embodiment, the abutment portion 101*b* has a first portion 101*c* and a second portion 101*d* positioned away from the first portion 101*c* in the rotation direction of the rotating cam 101. When the lever member 103 is at the first position, the first portion 101*c* and the second portion 101*d* are in contact with the first contact surface 103*a*.

In the present embodiment, the abutment portion 101*b* has a flat surface portion, and the flat surface portion also comes into contact with the first contact surface 103*a*. The first portion 101*c* and the second portion 101*d* are disposed at both ends of the flat surface portion (flatly shaped portion). A straight line L that orthogonally intersects a straight line connecting between the first portion 101*c* and the second portion 101*d* (the straight line L is the line normal to the flat surface portion in the present embodiment) crosses the rotation axis RC as viewed in the direction of the rotation axis RC.

In this state, in the case of the lever member 103 receiving an external force, the movement of the rotating cam 101 is restricted, which prevents the rotating cam 101 from rotating. For example, the lever member 103 may receive an external force when the processing cartridge 5 is installed or removed, or when a user touches the lever member 103 after the processing cartridge 5 is removed.

Accordingly, this reduces the likelihood of a load being applied to the mechanism (such as gears) for driving the rotating cam 101 at installation or removal of the processing cartridge 5.

Second Embodiment

A second embodiment will be described with reference to FIG. 10. Descriptions of the same elements that have been already described for the first embodiment will be omitted in the second embodiment. The elements described in the first embodiment will be denoted by the same reference signs, and duplicated descriptions will not be provided.

Figure 10:
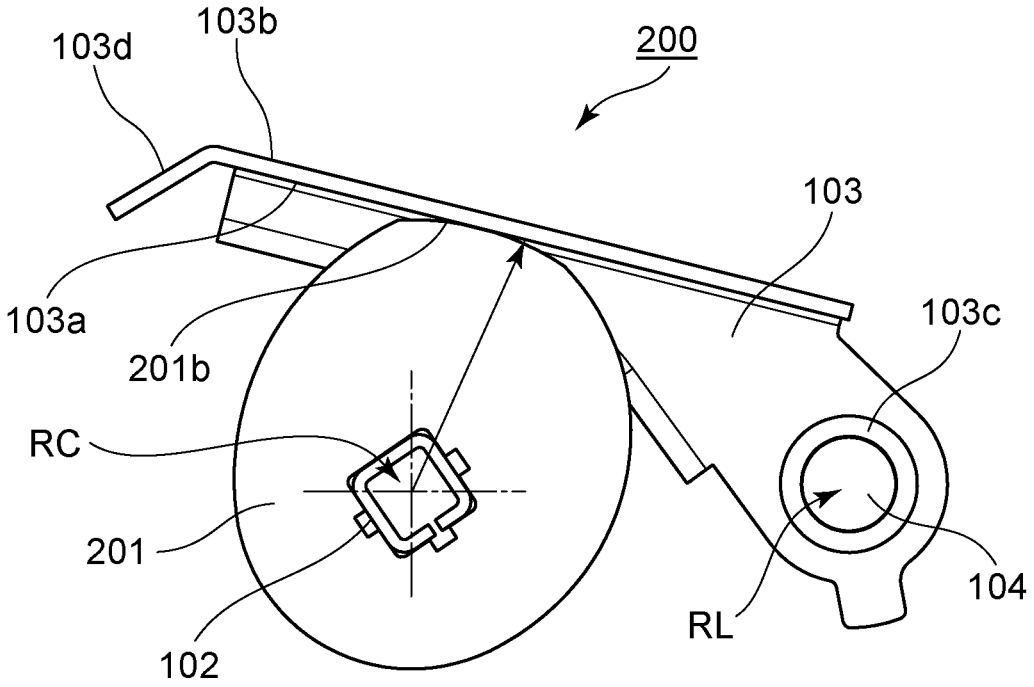
FIG. 10 is a detailed view illustrating a separation mechanism according to a second embodiment.

FIG. 10 is a detailed view illustrating a separation mechanism 200 according to the present embodiment. The separation mechanism 200 of the present embodiment corresponds to the separation mechanism 100 of the first embodiment. The separation mechanism 200, however, includes a rotating cam 201 including a shape different from that of the rotating cam 101 of the first embodiment.

The rotating cam 201 of the present embodiment has an abutment portion that comes into contact with the first contact surface 103*a* to hold the lever member 103 at the first position. The abutment portion has a circular arc surface (circular arc portion) 201*b*. The circular arc surface 201*b* is part of the cam surface of the rotating cam 201. The first contact surface 103*a* of the lever member 103 is in contact with the circular arc surface 201*b*. The center of the circular arc surface 201*b* is positioned at the center of rotation of the rotating cam 201. In other words, the circular arc surface 201*b* is shaped along an imaginary circle of which the center is positioned at the rotation axis RC of the rotating cam 201. In addition, the first contact surface 103*a* is positioned so as to be a tangent to the circular arc surface 201*b*.

When the lever member 103 receives an external force in this state, the force exerted on the rotating cam 201 by the lever member 103 is directed to the center of rotation of the rotating cam 201, which reduces the likelihood of a force acting so as to rotate the rotating cam 201. This reduces the likelihood of the rotating cam 201 rotating.

Accordingly, this reduces the likelihood of a load being applied to the mechanism (such as gears) for driving the rotating cam 101 at installation or removal of the processing cartridge 5.

Modification Examples

In the embodiments described above, the developing roller 16 is configured to come into contact with the photosensitive drum 11 to develop an electrostatic latent image. The developing roller 16, however, may be configured to develop the electrostatic latent image while a gap is present between the developing roller 16 and the photosensitive drum 11.

In the above description, the separation mechanism 100 or the separation mechanism 200 is disposed only at one side of the processing cartridge 5 in the axial direction of the photosensitive drum 11. The separation mechanism 100 or the separation mechanism 200 may be disposed at each side of the processing cartridge 5.

The lever member 103 may be supported by the main body 2 in such a manner that the supported portion 103*c* of the lever member 103 is formed as a shaft while a hole for receiving the shaft is formed at the position of the shaft 104 of the main body 2.

The present disclosure can be applied to an image forming apparatus configured such that the cartridge includes a first unit and a second unit that is movably connected to the first unit and the cartridge can be installed into or removed from the main body of the apparatus. Accordingly, the first unit is not limited to the drum unit 10, and the second unit is not limited to the developing unit 15.

The embodiments and the modification examples described above may be appropriately combined with one another when necessary.

As described above, the image forming apparatus according to the present disclosure can reduce the likelihood of a force being exerted from the cartridge onto the rotating member of the main body and causing the rotating member to rotate when the cartridge is installed into or removed from the main body.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2021-038668, filed Mar. 10, 2021, which is hereby incorporated by reference herein in its entirety.

What is claimed is:

1. An image forming apparatus, comprising:

a cartridge including a first unit and a second unit that is movably connected to the first unit; and a main body into which the cartridge is removably installed, the main body including a rotating member rotatable about a rotation axis, a supporting member disposed at a position away from the rotating member, and a swingable member that is pivotally movable about the supporting member and is configured to be moved by the rotating member, the swingable member including (i) a first contact surface configured to come into contact with the rotating member, (ii) a second contact surface configured to come into contact with the second unit and (iii) a supported portion supported by the supporting member, the swingable member being movable between a first position at which the swingable member is in contact with the second unit and a second position at which the swingable member is retracted from the first position, wherein installation and removal of the cartridge into and from the main body is enabled in a state where the swingable member is at the first position and is supported by the rotating member.

2. The image forming apparatus according to claim 1, wherein the rotating member includes an abutment portion configured to come into contact with the first contact surface so as to hold the swingable member at the first position.

3. The image forming apparatus according to claim 2, wherein the abutment portion includes a first portion and a second portion positioned away from the first portion in a rotation direction of the rotating member, and when the swingable member is at the first position, the first portion and the second portion are in contact with the first contact surface.

4. The image forming apparatus according to claim 2, wherein the abutment portion of the rotating member includes a flat surface portion, and a line normal to the flat surface portion intersects the rotation axis as viewed in a direction of the rotation axis.

5. The image forming apparatus according to claim 2, wherein the abutment portion includes a circular arc portion, and the circular arc portion is shaped along an imaginary circle of which a center is positioned at the rotation axis.

6. The image forming apparatus according to claim 1, wherein in the direction of the rotation axis, the first contact surface and the second contact surface are positioned so as to overlap each other at least partially.

7. The image forming apparatus according to claim 1, wherein the first unit includes an image carrying member configured to carry an electrostatic latent image, the second unit includes a developer carrying member configured to carry developer, and the second unit is configured to move between a development position at which the second unit develops the electrostatic latent image and a retracted position at which the second unit is retracted from the development position, and the second unit is at the retracted position when the swingable member is at the first position.

8. The image forming apparatus according to claim 1, wherein the cartridge is installed into and removed from the main body in a direction intersecting the rotation axis.

9. The image forming apparatus according to claim 1, wherein the swingable member extends downstream from the supported portion in a removing direction in which the cartridge is removed from the main body.

10. The image forming apparatus according to claim 9, wherein the swingable member includes a first end portion at which the supported portion is formed, and a second end portion that is positioned opposite to the first end portion in the removing direction and at which an inclined surface is formed.

11. The image forming apparatus according to claim 9, wherein the rotation axis is positioned downstream from the supporting member in the removing direction.

12. The image forming apparatus according to claim 1, wherein the swingable member is made of a material containing metal.

13. The image forming apparatus according to claim 1, wherein the main body includes a drive source that drives the rotating member, and a control unit that controls the drive source.

* * * * *